US009546806B2

(12) United States Patent
Haikawa et al.

(10) Patent No.: US 9,546,806 B2
(45) Date of Patent: Jan. 17, 2017

(54) AIR CONDITIONER

(71) Applicant: DAIKIN INDUSTRIES, LTD., Osaka-Shi, Osaka (JP)

(72) Inventors: Tomoyuki Haikawa, Kusatsu (JP); Youichi Ohnuma, Kusatsu (JP); Tomoatsu Minamida, Kusatsu (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/394,664

(22) PCT Filed: Apr. 4, 2013

(86) PCT No.: PCT/JP2013/060367
§ 371 (c)(1),
(2) Date: Oct. 15, 2014

(87) PCT Pub. No.: WO2013/157404
PCT Pub. Date: Oct. 24, 2013

(65) Prior Publication Data

US 2015/0068238 A1 Mar. 12, 2015

(30) Foreign Application Priority Data

Apr. 16, 2012 (JP) ..... 2012-093124

(51) Int. Cl.
*F25B 41/04* (2006.01)
*F24F 1/00* (2011.01)
(Continued)

(52) U.S. Cl.
CPC ..... *F25B 41/043* (2013.01); *F24F 1/0059* (2013.01); *F25B 13/00* (2013.01); *F25B 49/00* (2013.01);
(Continued)

(58) Field of Classification Search
CPC . F25B 41/043; F25B 49/00; F25B 2600/2513; F25B 2313/006
(Continued)

(56) References Cited

U.S. PATENT DOCUMENTS 4,878,355 A * 11/1989 Beckey et al. ..... 62/115
2006/0213208 A1* 9/2006 Iwaki et al. ..... 62/222
(Continued)

FOREIGN PATENT DOCUMENTS

EP 2 040 009 A1 3/2009
GB 2 305 744 A 4/1997
(Continued)

OTHER PUBLICATIONS

Hiroki et al., Air Conditioner, May 29, 2008, JP2008121996A, Whole Document.*
(Continued)

*Primary Examiner* — Larry Furdge
(74) *Attorney, Agent, or Firm* — Birch, Stewart, Kolasch & Birch, LLP

(57) ABSTRACT

When a fully-closable expansion valve is used, there is a possibility that the expansion valve is fully closed thereby to block a refrigerant circuit. In an air conditioner 1 of the present invention, an indoor heat exchanger 14 includes an auxiliary heat exchanger 20 and a main heat exchanger 21 disposed leeward from the auxiliary heat exchanger 20. In an operation in a predetermined dehumidification operation mode, a liquid refrigerant supplied to the auxiliary heat exchanger 20 all evaporates midway in the auxiliary heat exchanger 20, i.e., before reaching the outlet. Therefore, only an upstream partial area in the auxiliary heat exchanger 20 is an evaporation region, while an area downstream of the evaporation region in the auxiliary heat exchanger 20 is a superheat region. Further, an evaporation temperature sensor
(Continued)

30 which detects an evaporation temperature is disposed downstream of an expansion valve 13 in an outdoor unit 3.

4 Claims, 6 Drawing Sheets

(51) Int. Cl.
*F25B 13/00* (2006.01)
*F25B 49/00* (2006.01)

(52) U.S. Cl.
CPC .. *F24F 2001/0048* (2013.01); *F25B 2313/005* (2013.01); *F25B 2313/006* (2013.01); *F25B 2313/0232* (2013.01); *F25B 2313/0291* (2013.01); *F25B 2313/02341* (2013.01); *F25B 2313/02343* (2013.01); *F25B 2313/0314* (2013.01); *F25B 2600/2513* (2013.01); *F25B 2700/191* (2013.01)

(58) Field of Classification Search
USPC ..... 62/222
See application file for complete search history.

(56) References Cited

U.S. PATENT DOCUMENTS

| | | | | |
|---|---|---|---|---|
| 2006/0254294 | A1 | | 11/2006 | Shimamoto et al. |
| 2009/0188027 | A1 | | 7/2009 | Katsumi et al. |
| 2010/0000244 | A1 | * | 1/2010 | Kawakatsu et al. ..... 62/210 |
| 2013/0118197 | A1 | | 5/2013 | Kibo et al. |

FOREIGN PATENT DOCUMENTS

| | | | | |
|---|---|---|---|---|
| JP | 4-203847 | A | | 7/1992 |
| JP | 7-332736 | A | | 12/1995 |
| JP | H08320160 | A | * | 12/1996 |
| JP | 9-14727 | A | | 1/1997 |
| JP | 9-96452 | A | | 4/1997 |
| JP | 9-152168 | A | | 6/1997 |
| JP | 2003176943 | A | * | 6/2003 |
| JP | 2005315031 | A | * | 12/2005 |
| JP | 2007-40567 | A | | 2/2007 |
| JP | 2008121996 | A | * | 5/2008 |
| JP | 2009-236346 | A | | 10/2009 |
| JP | 2012-32108 | A | | 2/2012 |

OTHER PUBLICATIONS

Masakazu, Heat Pump Type Air Conditioner, Dec. 3, 1996, JPH08320160A, Whole Document.*

Hiroshi, Multiple Air Conditioner and its Throttle Valve Opening and Closing Operation Determining Method, Dec. 15, 2005, JP2005345031A, Whole Document.*

Motoshi, Air Conditioner, Jun. 27, 2003, JP2003176943A, Whole Document.*

International Search Report issued in PCT/JP2013/060367, mailed on Jul. 2, 2013.

International Preliminary Report on Patentability of PCT/JP2013/060367 with English translation dated Oct. 21, 2014.

* cited by examiner

AIR CONDITIONER

TECHNICAL FIELD

The present invention relates to an air conditioner configured to perform a dehumidification operation.

BACKGROUND ART

There has been a conventional air conditioner in which: an auxiliary heat exchanger is disposed rearward of a main heat exchanger; and a refrigerant evaporates only in the auxiliary heat exchanger to locally perform dehumidification so that dehumidification can be performed even under a low load (even when the number of revolution of a compressor is small), for example, when the difference between room temperature and a set temperature is sufficiently small and therefore the required cooling capacity is small.

CITATION LIST

Patent Literature

Patent Literature 1: Japanese Unexamined Patent Publication No. 14727/1997 (Tokukaihei 09-14727)

SUMMARY OF INVENTION

Technical Problem

In this air conditioner, the amount of circulating refrigerant decreases with the decrease in the cooling capacity, and therefore the opening degree of the expansion valve has to be reduced proportionally thereto. However, if used is a generally-used expansion valve having the opening degree-flow rate characteristic that the valve is not fully closed because of a lower limit on the flow rate, there is a possibility that the lower limit is too large to sufficiently restrict the flow, so that the evaporation temperature cannot be decreased. The above problem is solved by using a fully closable expansion valve. However, this in turn causes another problem of the blockage of the refrigerant circuit if the valve is fully closed.

Further, if the amount of newly supplied refrigerant decreases to an excessively small amount under the condition that a detecting means for detecting the evaporation temperature is provided in the indoor unit, the refrigerant all evaporates before reaching the detecting means, which makes it impossible to detect the evaporation temperature of the refrigerant. As a result, it is not possible to detect the blockage of the refrigerant circuit due to excessive restriction. If the refrigerant circuit is blocked, dehumidification and cooling cannot be performed. In addition, there arises a problem of overheating of the compressor.

In view of the above, an object of the present invention is to provide an air conditioner in which the blockage of a refrigerant circuit due to the full closure of an expansion valve is detected when a fully closable expansion valve is used.

Solution to Problem

An air conditioner according to a first aspect of the present invention includes a refrigerant circuit in which a compressor, an outdoor heat exchanger, an expansion valve, and an indoor heat exchanger are connected to one another, the air conditioner configured to perform a cooling operation in which the entirety of the indoor heat exchanger functions as an evaporation region and a dehumidification operation in which a part of the indoor heat exchanger functions as the evaporation region. The compressor, the outdoor heat exchanger, and the expansion valve are disposed in an outdoor unit. The indoor heat exchanger is disposed in an indoor unit. An evaporation temperature detecting means for detecting an evaporation temperature is disposed downstream of the expansion valve in the outdoor unit.

In this air conditioner, the evaporation temperature detecting means for detecting the evaporation temperature is disposed downstream of the expansion valve in the outdoor unit. This ensures detection of the reduction of the pressure (the reduction of the temperature) due to the blockage of the circuit at the time when the expansion valve is fully closed. This further ensures that the flow rate is restricted just before the expansion valve is fully closed even while the flow rate is very small, to decrease the evaporation temperature, for performing dehumidification.

According to a second aspect of the present invention, in the air conditioner of the first aspect of the present invention, the expansion valve is configured so that its flow rate decreases with a decrease in its opening degree while the expansion valve is in a state close to a fully closed state.

In this air conditioner, adjustment of the flow rate is possible even just before the full closure of the expansion valve, and the control on the evaporation temperature is possible even while the flow rate is very small.

According to a third aspect of the present invention, in the air conditioner of the first or second aspect of the present invention, the expansion valve is fully closable.

In this air conditioner, it is possible to sufficiently decrease the evaporating pressure with a minuscule opening degree just before the opening degree corresponding to the fully closed state.

According to a fourth aspect of the present invention, in the air conditioner of any one of the first to third aspects, when the opening degree of the expansion valve is decreased toward the opening degree corresponding to the fully closed state, a decrement of the flow rate to an amount of change in the opening degree increases after the opening degree of the expansion valve is decreased to a predetermined opening degree close to the opening degree corresponding to the fully closed state.

In this air conditioner, the amount of change in the flow rate to the amount of change in the opening degree is thus increased just before the valve is fully closed, and this increases the difference between the evaporation temperature in the fully closed state and that just before the fully closed state, to make it easier to recognize that the valve is about to be closed, thereby facilitating avoidance of the blockage of the circuit due to the full closure of the valve.

Advantageous Effects of Invention

As described above, the present invention provides the following advantageous effects.

In the first aspect of the present invention, the evaporation temperature detecting means for detecting the evaporation temperature is disposed downstream of the expansion valve in the outdoor unit. This ensures detection of the reduction of the pressure (the reduction of the temperature) due to the blockage of the circuit at the time when the expansion valve is fully closed. This further ensures that the flow rate is restricted just before the expansion valve is fully closed even while the flow rate is very small, to decrease the evaporation temperature, for performing dehumidification.

In the second aspect of the present invention, adjustment of the flow rate is possible even just before the full closure of the expansion valve, and the control on the evaporation temperature is possible even while the flow rate is very small.

In the third aspect of the present invention, it is possible to sufficiently decrease the evaporating pressure with a minuscule opening degree just before the opening degree corresponding to the fully closed state.

In the fourth aspect of the present invention, the amount of change in the flow rate to the amount of change in the opening degree is thus increased just before the valve is fully closed, and this increases the difference between the evaporation temperature in the fully closed state and that just before the fully closed state, to make it easier to recognize that the valve is about to be closed, thereby facilitating avoidance of the blockage of the circuit due to the full closure of the valve.

DESCRIPTION OF EMBODIMENTS

The following describes an air conditioner 1 of an embodiment of the present invention.

<Overall Structure of Air Conditioner 1>

Figure 1:
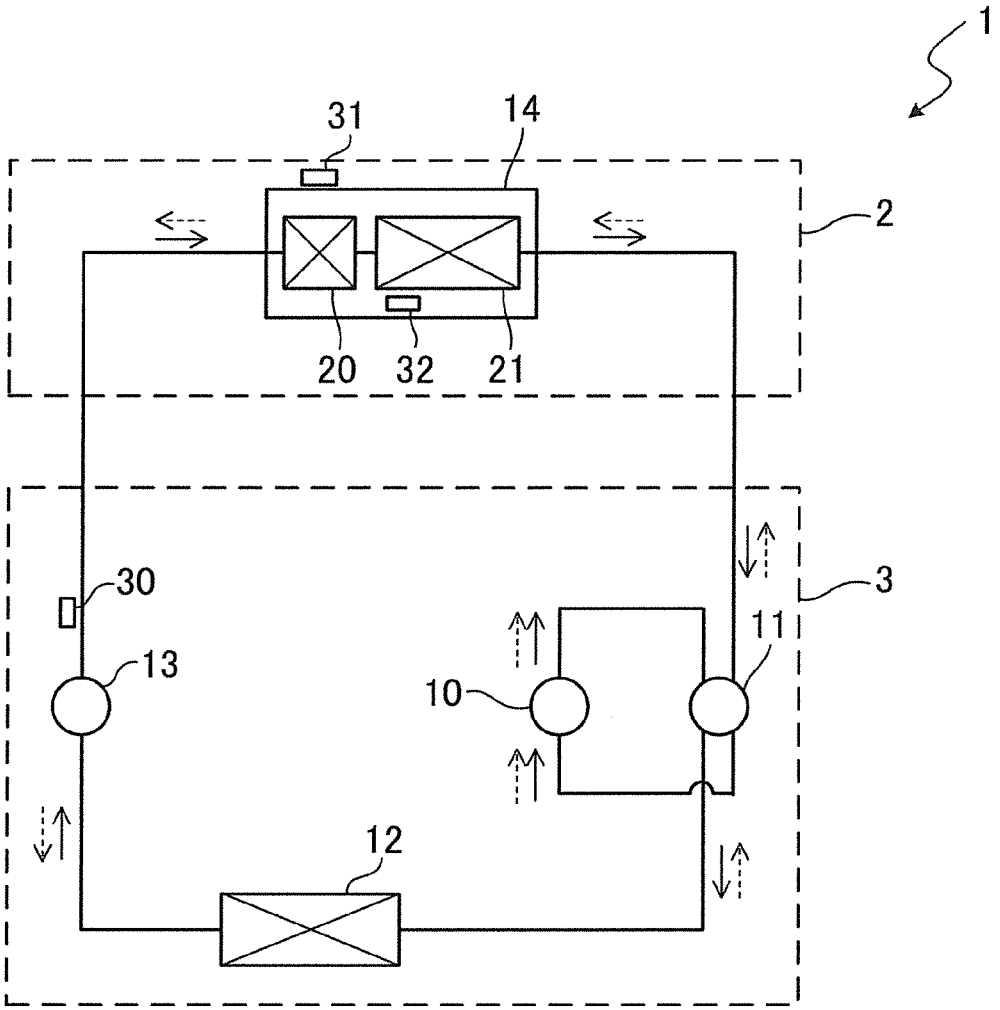
FIG. 1 is a circuit diagram showing a refrigerant circuit of an air conditioner of an embodiment of the present invention.
Figure 2:
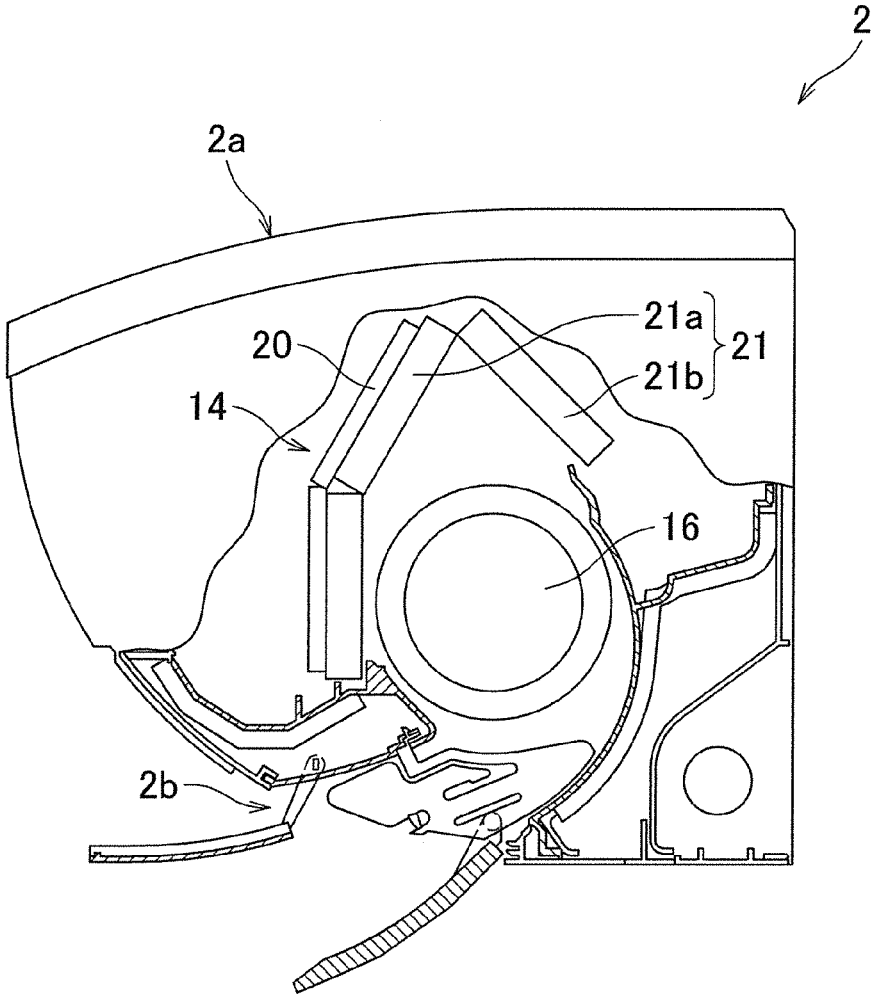
FIG. 2 is a schematic cross section of an indoor unit of the air conditioner of the embodiment of the present invention.

As shown in FIG. 1, the air conditioner 1 of this embodiment includes: an indoor unit 2 installed inside a room; and an outdoor unit 3 installed outside the room. The air conditioner 1 further includes a refrigerant circuit in which a compressor 10, a four-way valve 11, an outdoor heat exchanger 12, an expansion valve 13, and an indoor heat exchanger 14 are connected to one another. In the refrigerant circuit, the outdoor heat exchanger 12 is connected to a discharge port of the compressor 10 via the four-way valve 11, and the expansion valve 13 is connected to the outdoor heat exchanger 12. Further, one end of the indoor heat exchanger 14 is connected to the expansion valve 13, and the other end of the indoor heat exchanger 14 is connected to an intake port of the compressor 10 via the four-way valve 11. The indoor heat exchanger 14 includes an auxiliary heat exchanger 20 and a main heat exchanger 21.

In the air conditioner 1, operations in a cooling operation mode, in a predetermined dehumidification operation mode, and in a heating operation mode are possible. Using a remote controller, various operations are possible: selecting one of the operation modes to start the operation, changing the operation mode, stopping the operation, and the like. Further, using the remote controller, it is possible to adjust indoor temperature setting, and to change the air volume of the indoor unit 2 by changing the number of revolutions of an indoor fan.

As indicated with solid arrows in the figure, in the cooling operation mode and in the predetermined dehumidification operation mode, there are respectively formed a cooling cycle and a dehumidification cycle, in each of which: a refrigerant discharged from the compressor 10 flows, from the four-way valve 11, through the outdoor heat exchanger 12, the expansion valve 13, and the auxiliary heat exchanger 20, to the main heat exchanger 21 in order; and the refrigerant having passed through the main heat exchanger 21 returns back to the compressor 10 via the four-way valve 11. That is, the outdoor heat exchanger 12 functions as a condenser, and the indoor heat exchanger 14 (the auxiliary heat exchanger 20 and the main heat exchanger 21) functions as an evaporator.

Meanwhile, in the heating operation mode, the state of the four-way valve 11 is switched, to form a heating cycle in which: the refrigerant discharged from the compressor 10 flows, from the four-way valve 11, through the main heat exchanger 21, the auxiliary heat exchanger 20, and the expansion valve 13, to the outdoor heat exchanger 12 in order; and the refrigerant having passed through the outdoor heat exchanger 12 returns back to the compressor 10 via the four-way valve 11, as indicated with broken arrows in the figure. That is, the indoor heat exchanger 14 (the auxiliary heat exchanger 20 and the main heat exchanger 21) functions as the condenser, and the outdoor heat exchanger 12 functions as the evaporator.

The indoor unit 2 has, on its upper surface, an air inlet 2*a* through which indoor air is taken in. The indoor unit 2 further has, on a lower portion of its front surface, an air outlet 2*b* through which air for air conditioning comes out. Inside the indoor unit 2, an airflow path is formed from the air inlet 2*a* to the air outlet 2*b*. In the airflow path, the indoor heat exchanger 14 and a cross-flow indoor fan 16 are disposed. Therefore, as the indoor fan 16 rotates, the indoor air is taken into the indoor unit 1 through the air inlet 2*a*. In a front portion of the indoor unit 2, the air taken in through the air inlet 2*a* flows through the auxiliary heat exchanger 20 and the main heat exchanger 21 toward the indoor fan 16. Meanwhile, in a rear portion of the indoor unit 2, the air taken in through the air inlet 2*a* flows through the main heat exchanger 21 toward the indoor fan 16.

As described above, the indoor heat exchanger 14 includes: the auxiliary heat exchanger 20; and the main heat exchanger 21 located downstream of the auxiliary heat exchanger 20 in an operation in the cooling operation mode or in the predetermined dehumidification operation mode. The main heat exchanger 21 includes: a front heat exchanger 21*a* disposed on a front side of the indoor unit 2; and a rear heat exchanger 21*b* disposed on a rear side of the indoor unit 2. The heat exchangers 21*a* and 21*b* are arranged in a shape of a counter-V around the indoor fan 16. Further, the auxiliary heat exchanger 20 is disposed forward of the front heat exchanger 21*a*. Each of the auxiliary heat exchanger 20 and the main heat exchanger 21 (the front heat exchanger 21*a* and the rear heat exchanger 21*b*) includes heat exchanger pipes and a plurality of fins.

Figure 3:
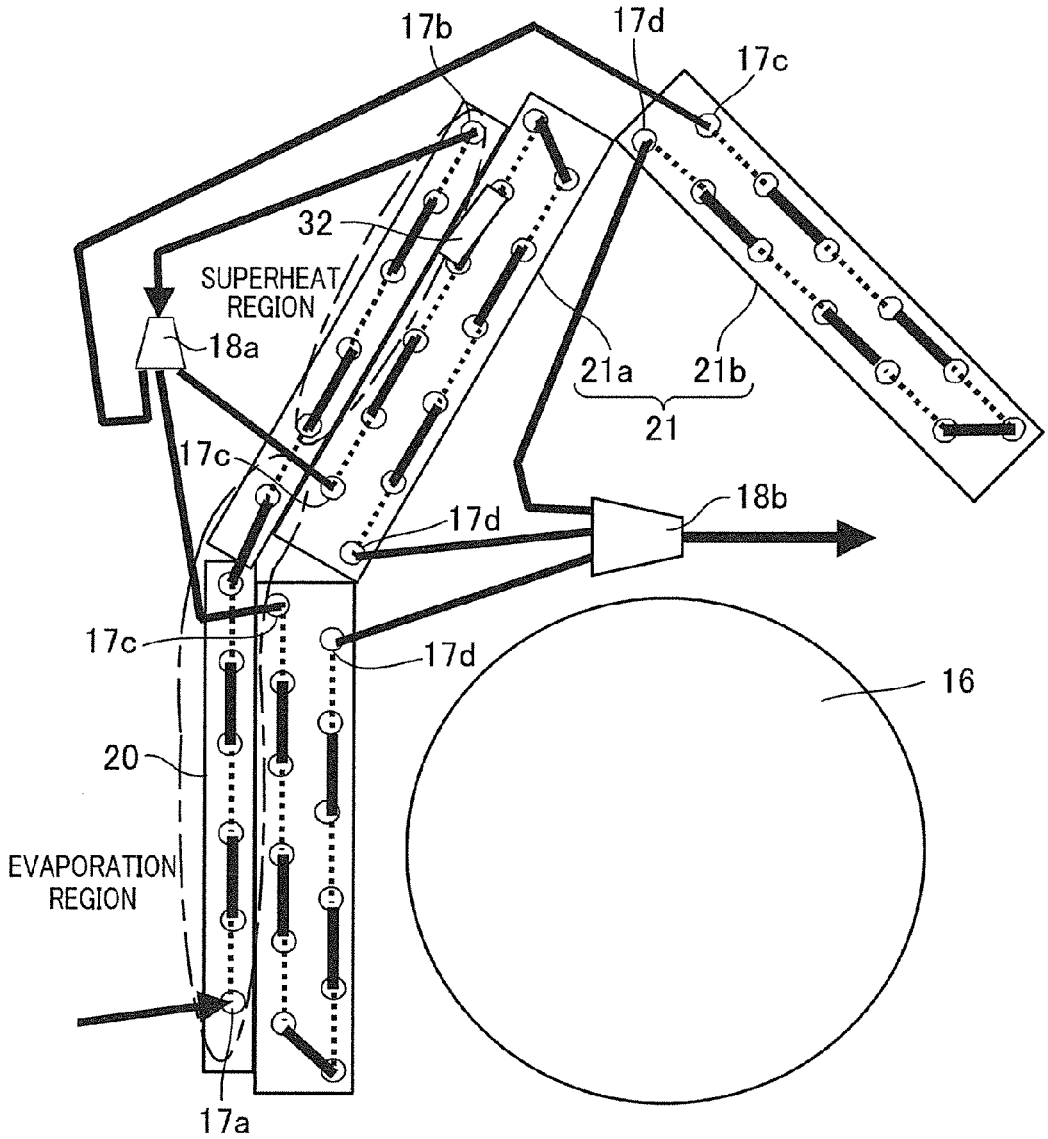
FIG. 3 is a diagram illustrating the structure of an indoor heat exchanger.

In the cooling operation mode and in the predetermined dehumidification operation mode, a liquid refrigerant is supplied through a liquid inlet 17*a* provided in the vicinity of a lower end of the auxiliary heat exchanger 20, and the thus supplied liquid refrigerant flows toward an upper end of the auxiliary heat exchanger 20, as shown in FIG. 3. Then, the refrigerant is discharged through an outlet 17*b* provided in the vicinity of the upper end of the auxiliary heat exchanger 20, and then flows to a branching section 18*a*. The refrigerant is divided at the branching section 18*a* into branches, which are respectively supplied, via three inlets 17*c* of the main heat exchanger 21, to a lower portion and an upper portion of the front heat exchanger 21*a* and to the rear heat exchanger 21*b*. Then, the branched refrigerant is discharged through outlets 17*d*, to merge together at a merging section 18*b*. In the heating operation mode, the refrigerant flows in a reverse direction of the above direction.

When the air conditioner 1 operates in the predetermined dehumidification operation mode, the liquid refrigerant supplied through the liquid inlet 17*a* of the auxiliary heat exchanger 20 all evaporates midway in the auxiliary heat exchanger 20, i.e., before reaching the outlet. Therefore, only a partial area in the vicinity of the liquid inlet 17*a* of the auxiliary heat exchanger 20 is an evaporation region where the liquid refrigerant evaporates. Accordingly, in the operation in the predetermined dehumidification operation mode, only the upstream partial area in the auxiliary heat exchanger 20 is the evaporation region, while (i) the area downstream of the evaporation region in the auxiliary heat exchanger 20 and (ii) the main heat exchanger 21 each functions as a superheat region, in the indoor heat exchanger 14.

Further, the refrigerant having flowed through the superheat region in the vicinity of the upper end of the auxiliary heat exchanger 20 flows through the lower portion of the front heat exchanger 21*a* disposed leeward from a lower portion of the auxiliary heat exchanger 20. Therefore, among the air taken in through the air inlet 2*a*, air having been cooled in the evaporation region of the auxiliary heat exchanger 20 is heated by the front heat exchanger 21*a*, and then blown out from the air outlet 2*b*. Meanwhile, among the air taken in through the air inlet 2*a*, air having flowed through the superheat region of the auxiliary heat exchanger 20 and through the front heat exchanger 21*a*, and air having flowed through the rear heat exchanger 21*b* are blown out from the air outlet 2*b* at a temperature substantially the same as an indoor temperature.

In the air conditioner 1, an evaporation temperature sensor 30 is attached to the outdoor unit 3, as shown in FIG. 1. The evaporation temperature sensor 30 is configured to detect an evaporation temperature and is disposed downstream of the expansion valve 13 in the refrigerant circuit. Further, to the indoor unit 2, there are attached: an indoor temperature sensor 31 configured to detect the indoor temperature (the temperature of the air taken in through the air inlet 2*a* of the indoor unit 2); and an indoor heat exchanger temperature sensor 32 configured to detect whether evaporation of the liquid refrigerant is completed in the auxiliary heat exchanger 20.

As shown in FIG. 3, the indoor heat exchanger temperature sensor 32 is disposed in the vicinity of the upper end of the auxiliary heat exchanger 20 and leeward from the auxiliary heat exchanger 20. Further, in the superheat region in the vicinity of the upper end of the auxiliary heat exchanger 20, the air taken in through the air inlet 2*a* is hardly cooled. Therefore, when the temperature detected by the indoor heat exchanger temperature sensor 32 is substantially the same as the indoor temperature detected by the indoor temperature sensor 31, it is indicated that evaporation is completed midway in the auxiliary heat exchanger 20, and that the area in the vicinity of the upper end of the auxiliary heat exchanger 20 is the superheat region. Furthermore, the indoor heat exchanger temperature sensor 32 is provided to a heat-transfer tube in a middle portion of the indoor heat exchanger 14. Thus, in the vicinity of the middle portion of the indoor heat exchanger 14, detected are the condensation temperature in the heating operation and the evaporation temperature in the cooling operation.

Figure 4:
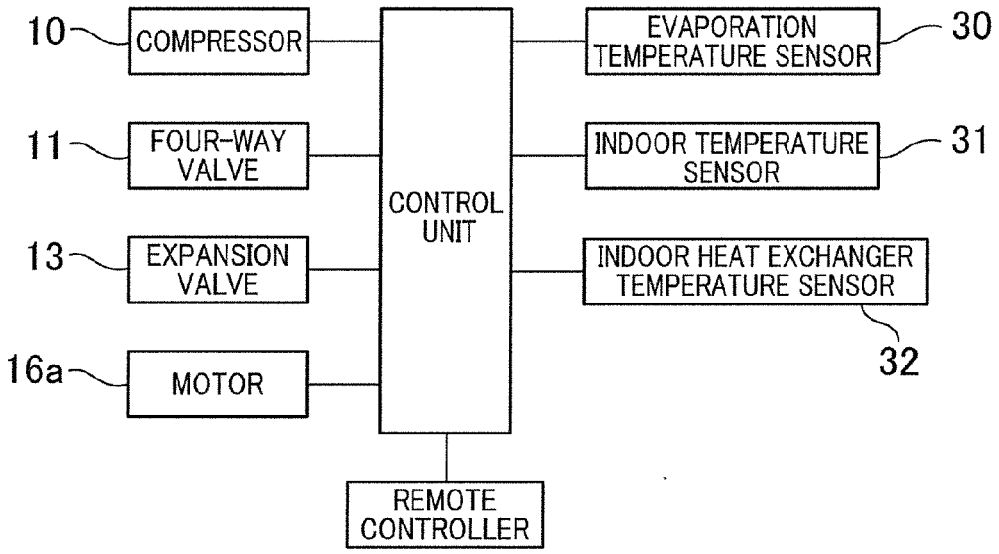
FIG. 4 is a diagram illustrating a control unit of the air conditioner of the embodiment of the present invention.

As shown in FIG. 4, the control unit of the air conditioner 1 is connected with: the compressor 10; the four-way valve 11; the expansion valve 13; a motor 16*a* for driving the indoor fan 16; the evaporation temperature sensor 30; the indoor temperature sensor 31; and the indoor heat exchanger temperature sensor 32. Therefore, the control unit controls the operation of the air conditioner 1 based on: a command from the remote controller (for the start of the operation, for indoor temperature setting, or the like); the evaporation temperature detected by the evaporation temperature sensor 30; the indoor temperature detected by the indoor temperature sensor 31 (the temperature of the intake air); and a heat exchanger middle temperature detected by the indoor heat exchanger temperature sensor 32.

Further, in the air conditioner 1, the auxiliary heat exchanger 20 includes the evaporation region where the liquid refrigerant evaporates and the superheat region downstream of the evaporation region in the predetermined dehumidification operation mode. The compressor 10 and the expansion valve 13 are controlled so that the extent of the evaporation region varies depending on a load. Here, "the extent varies depending on a load" means that the extent varies depending on the quantity of heat supplied to the evaporation region, and the quantity of heat is determined, for example, by the indoor temperature (the temperature of the intake air) and an indoor air volume. Further, the load corresponds to a required dehumidification capacity (required cooling capacity), and the load is determined taking into account, for example, the difference between the indoor temperature and the set temperature.

The compressor 10 is controlled based on the difference between the indoor temperature and the set temperature. When the difference between the indoor temperature and the set temperature is large, the load is high, and therefore the compressor 10 is controlled so that its frequency increases. When the difference between the indoor temperature and the set temperature is small, the load is low, and therefore the compressor 10 is controlled so that its frequency decreases.

The expansion valve 13 is controlled based on the evaporation temperature detected by the evaporation temperature sensor 30. While the frequency of the compressor 10 is controlled as described above, the expansion valve 13 is controlled so that the evaporation temperature falls within a predetermined temperature range (10 to 14 degrees Celsius) close to a target evaporation temperature (12 degrees Celsius). It is preferable that the predetermined evaporation temperature range is constant, irrespective of the frequency of the compressor 10. However, the predetermined range may be slightly changed with the change of the frequency as long as the predetermined range is substantially constant.

Thus, the compressor 10 and the expansion valve 13 are controlled depending on the load in the predetermined dehumidification operation mode, and thereby changing the extent of the evaporation region of the auxiliary heat exchanger 20, and causing the evaporation temperature to fall within the predetermined temperature range.

In the air conditioner 1, each of the auxiliary heat exchanger 20 and the front heat exchanger 21*a* has twelve rows of the heat-transfer tubes. When the number of rows of the tubes functioning as the evaporation region in the auxiliary heat exchanger 20 in the predetermined dehumidification operation mode is not less than a half of the total number of rows of the tubes of the front heat exchanger 21*a*, it is possible to sufficiently increase the extent of the evaporation region of the auxiliary heat exchanger, and therefore a variation in the load is addressed sufficiently. This structure is effective especially under a high load.

Figure 5:
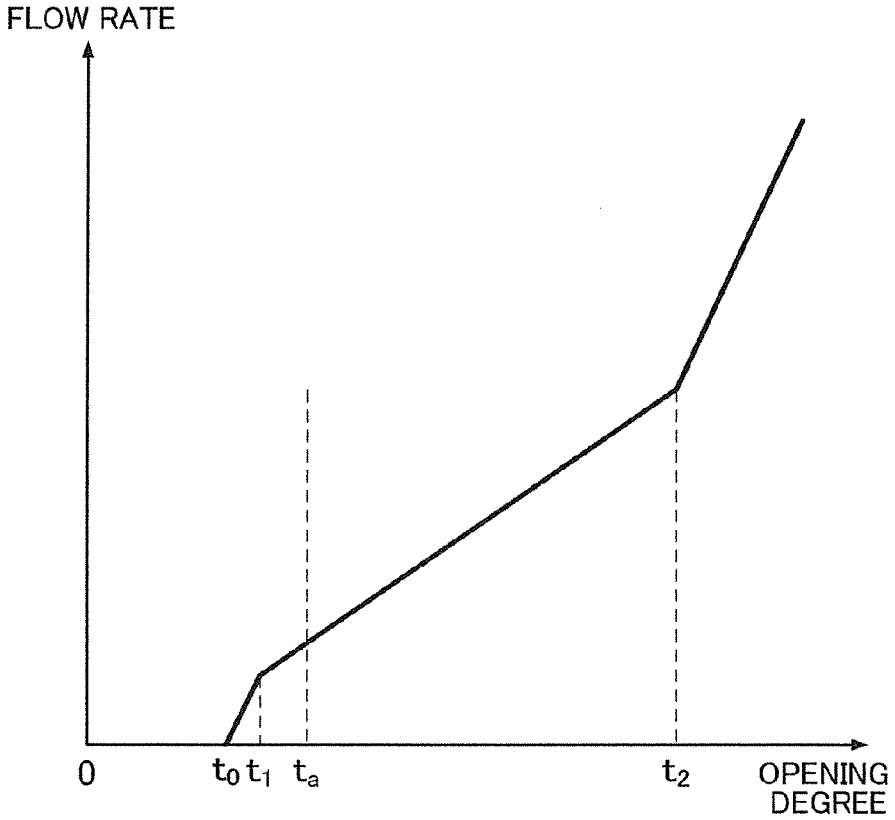
FIG. 5 is a graph showing, by way of example, how the flow rate changes as the opening degree of an expansion valve is changed.

FIG. 5 is a graph showing how the flow rate changes when the opening degree of the expansion valve 13 is changed. The opening degree of the expansion valve 13 continuously changes with the number of driving pulses input to the expansion valve 13. As the opening degree decreases, the flow rate of the refrigerant flowing through the expansion valve 13 decreases. The expansion valve 13 is fully closed when the opening degree is t0. In the range of the opening degrees t0 to t1, the flow rate increases at a first gradient as the opening degree increases. In the range of the opening degrees t1 to t2, the flow rate increases at a second gradient as the opening degree increases. Note that the first gradient is larger than the second gradient. When the opening degree of the expansion valve 13 is decreased toward the opening degree t0 corresponding to the fully closed state of the expansion valve 13, the decrement of the flow rate to the amount of change in the opening degree increases after the opening degree of the expansion valve 13 is decreased to a predetermined opening degree t1 close to the opening degree corresponding to the fully closed state.

Figure 6:
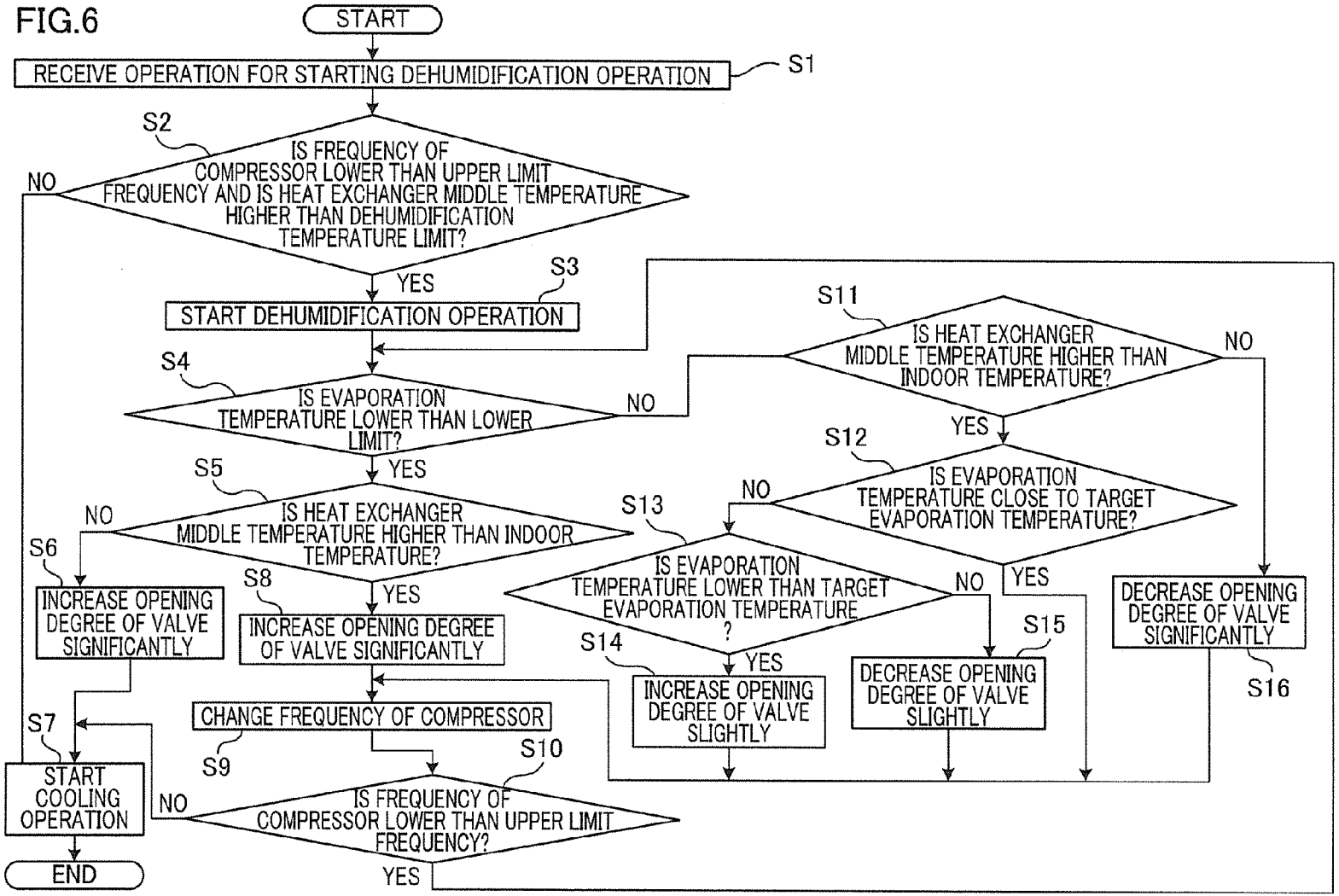
FIG. 6 is a flowchart illustrating control in an operation in a dehumidification operation mode.

With reference to FIG. 6, description will be given for the control in an operation in the predetermined dehumidification operation mode in the air conditioner 1.

First, when an operation for starting the dehumidification operation is performed on the remote controller (step S1), it is determined whether the frequency of the compressor is lower than an upper limit frequency and whether the heat exchanger middle temperature is higher than a dehumidification temperature limit, and thereby it is determined whether dehumidification is impossible in the cooling operation due to a low load (step S2). In step S2, it is determined whether dehumidification is impossible in the cooling operation due to a low load because the frequency of the compressor is lower than the upper limit frequency in the dehumidification operation mode. However, even though the frequency of the compressor is lower than the upper limit frequency, dehumidification is possible when the evaporation temperature is low. Therefore, when the evaporation temperature is lower than the dehumidification temperature limit, it is not determined that dehumidification is impossible in the cooling operation due to a low load. Accordingly, in step S2, it is determined that dehumidification is impossible in the cooling operation when the load is low and the evaporation temperature is higher than the dehumidification temperature limit.

Then, when it is determined that the frequency of the compressor is lower than the upper limit frequency and the heat exchanger middle temperature is higher than the dehumidification temperature limit (step S2: YES), dehumidification is impossible in the cooling operation due to a low load. Therefore, the opening degree of the valve is rapidly decreased, and then the dehumidification operation is started (step S3). Then, the dehumidification operation is started in which: the liquid refrigerant supplied through the liquid inlet 17*a* of the auxiliary heat exchanger 20 all evaporates midway in the auxiliary heat exchanger 20; and therefore only a partial area in the vicinity of the liquid inlet 17*a* of the auxiliary heat exchanger 20 functions as the evaporation region.

After the dehumidification operation is started, it is determined whether the evaporation temperature detected by the evaporation temperature sensor 30 is lower than a lower limit, to determine whether the evaporation temperature is too low. (step S4). When the evaporation temperature is lower than the lower limit (lower limit for preventing the closure of the expansion valve 13), it is indicated that the expansion valve 13 is almost closed. Therefore, in step S4, it is determined whether the expansion valve 13 is almost closed, to determine whether the opening degree of the valve needs to be increased.

Then, when it is determined that the evaporation temperature is lower than the lower limit (the expansion valve 13 is almost closed) (step S4: YES), it is determined whether the heat exchanger middle temperature (the temperature of the air in the vicinity of the upper end of the auxiliary heat exchanger 20 and leeward from the auxiliary heat exchanger 20) is higher than the indoor temperature, thereby to determine whether evaporation is completed in the auxiliary heat exchanger 20 (step S5). When the area in the vicinity of the upper end of the auxiliary heat exchanger 20 is the superheat region, the air taken in through the air inlet 2*a* is hardly cooled in the area in the vicinity of the upper end of the auxiliary heat exchanger 20, and therefore, the heat exchanger middle temperature detected by the indoor heat exchanger temperature sensor 32 is close to or higher than the indoor temperature detected by the indoor temperature sensor 31. Accordingly, in step S5, when the heat exchanger middle temperature is equal to or higher than a temperature obtained by subtracting a correction amount from the indoor temperature, it is determined that the temperature of the air in the vicinity of the upper end of the auxiliary heat exchanger 20 and leeward from the auxiliary heat exchanger 20 is higher than the indoor temperature, and it is determined that the area in the vicinity of the upper end of the auxiliary heat exchanger 20 is the superheat region, and hence evaporation is completed in the auxiliary heat exchanger 20.

When the heat exchanger middle temperature (the temperature of the air in the vicinity of the upper end of the auxiliary heat exchanger 20 and leeward from the auxiliary heat exchanger 20) is lower than the indoor temperature (step S5: NO), the opening degree of the valve is rapidly increased even though evaporation is not completed within the auxiliary heat exchanger 20 (step S6). Then, the cooling operation is started in the state where the liquid refrigerant supplied through the liquid inlet 17*a* of the auxiliary heat exchanger 20 flows into the main heat exchanger 21 (step S7).

On the other hand, when the heat exchanger middle temperature (the temperature of the air in the vicinity of the upper end of the auxiliary heat exchanger 20 and leeward from the auxiliary heat exchanger 20) is higher than the indoor temperature (step S5: YES), evaporation is completed within the auxiliary heat exchanger 20 and the auxiliary heat exchanger 20 has the evaporation region and the superheat region. In this state, the opening degree of the valve is significantly increased (step S8). Thereafter, the frequency of the compressor is changed so that the indoor temperature approaches the set temperature (step S9). Then, it is determined whether the frequency of the compressor is lower than the upper limit frequency (step S10). When the frequency of the compressor is equal to or higher than the upper limit frequency (step S10: NO), dehumidification is possible in the cooling operation, and therefore the cooling operation is started (step S7). When the frequency of the compressor is lower than the upper limit frequency (step S10: YES), the routine proceeds to step S4 while keeping the dehumidification operation.

When, in step S2, it is determined that the frequency of the compressor is equal to or higher than the upper limit frequency, or that the heat exchanger middle temperature is equal to or lower than the dehumidification temperature limit (step S2: NO), dehumidification is possible in the cooling operation, and therefore the cooling operation is started (step S7).

When, in step S4, the evaporation temperature detected by the evaporation temperature sensor 30 is equal to or higher than the lower limit (step S4: NO), it is determined whether the heat exchanger middle temperature (the temperature of the air in the vicinity of the upper end of the auxiliary heat exchanger 20 and leeward from the auxiliary heat exchanger 20) is higher than the indoor temperature, thereby to determine whether evaporation is completed within the auxiliary heat exchanger 20 (step S11).

When the heat exchanger middle temperature (the temperature of the air in the vicinity of the upper end of the auxiliary heat exchanger 20 and leeward from the auxiliary heat exchanger 20) is higher than the indoor temperature (step S11: YES), evaporation is completed within the auxiliary heat exchanger 20, and the auxiliary heat exchanger 20 has the evaporation region and the superheat region. Then, it is determined whether the evaporation temperature falls within the predetermined temperature range close to the target evaporation temperature (step S12). Thus, in step S12, it is determined whether the opening degree of the valve needs to be changed so that the evaporation temperature detected by the evaporation temperature sensor 30 falls within the predetermined temperature range close to the target evaporation temperature.

When, in step S12, the evaporation temperature falls within the predetermined temperature range close to the target evaporation temperature (step S12: YES), there is no need to change the opening degree of the valve, and therefore the routine proceeds to step S9.

On the other hand, when the evaporation temperature does not fall within the predetermined temperature range close to the target evaporation temperature (step S12: NO), it is determined whether the evaporation temperature is lower than the target evaporation temperature (step S13). When the evaporation temperature is lower than the target evaporation temperature (step S13: YES), the opening degree of the valve is slightly increased so that the evaporation temperature becomes closer to the target evaporation temperature (step S14). When the evaporation temperature is higher than the target evaporation temperature (step S13: NO), the opening degree of the valve is slightly decreased so that the evaporation temperature becomes closer to the target evaporation temperature (step S15). Then, the routine proceeds to step S9.

When, in step S11, the heat exchanger middle temperature (the temperature of the air in the vicinity of the upper end of the auxiliary heat exchanger 20 and leeward from the auxiliary heat exchanger 20) is equal to or lower than the indoor temperature (step S11: NO), evaporation is not completed within the auxiliary heat exchanger 20, and therefore the opening degree of the valve is significantly closed (step S16). Then, the routine proceeds to step S9.

Thus, in the air conditioner 1, control is made so that the extent of the evaporation region of the auxiliary heat exchanger 20 varies in the predetermined dehumidification operation mode. For example, when the load increases in the predetermined dehumidification operation mode on the condition that the extent of the evaporation region of the auxiliary heat exchanger 20 is of a predetermined size, the frequency of the compressor 10 is increased and the opening degree of the expansion valve 13 is changed so as to increase. As a result, the extent of the evaporation region of the auxiliary heat exchanger 20 becomes larger than that of the predetermined size, and this increases the volume of the air actually passing through the evaporation region even when the volume of the air taken into the indoor unit 2 is constant.

Meanwhile, when the load becomes lower in the predetermined dehumidification operation mode on the condition that the extent of the evaporation region of the auxiliary heat exchanger 20 is of the predetermined size, the frequency of the compressor 10 is decreased and the opening degree of the expansion valve 13 is changed so as to decrease. Therefore, the extent of the evaporation region of the auxiliary heat exchanger 20 becomes smaller than that of the predetermined size, and this decreases the volume of the air actually passing through the evaporation region even when the volume of the air taken into the indoor unit 2 is constant.

Figure 7B:
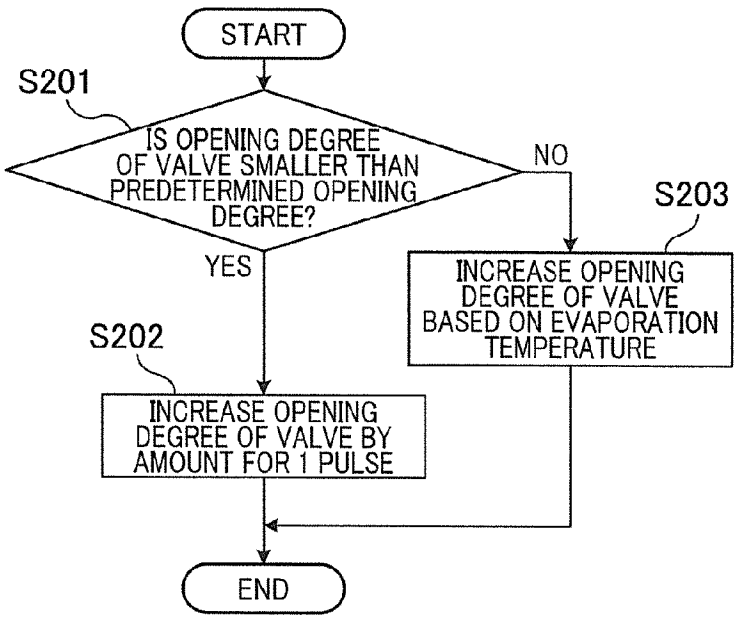
FIGS. 7A and 7B are flowcharts illustrating how to control the expansion valve.
Figure 7A:
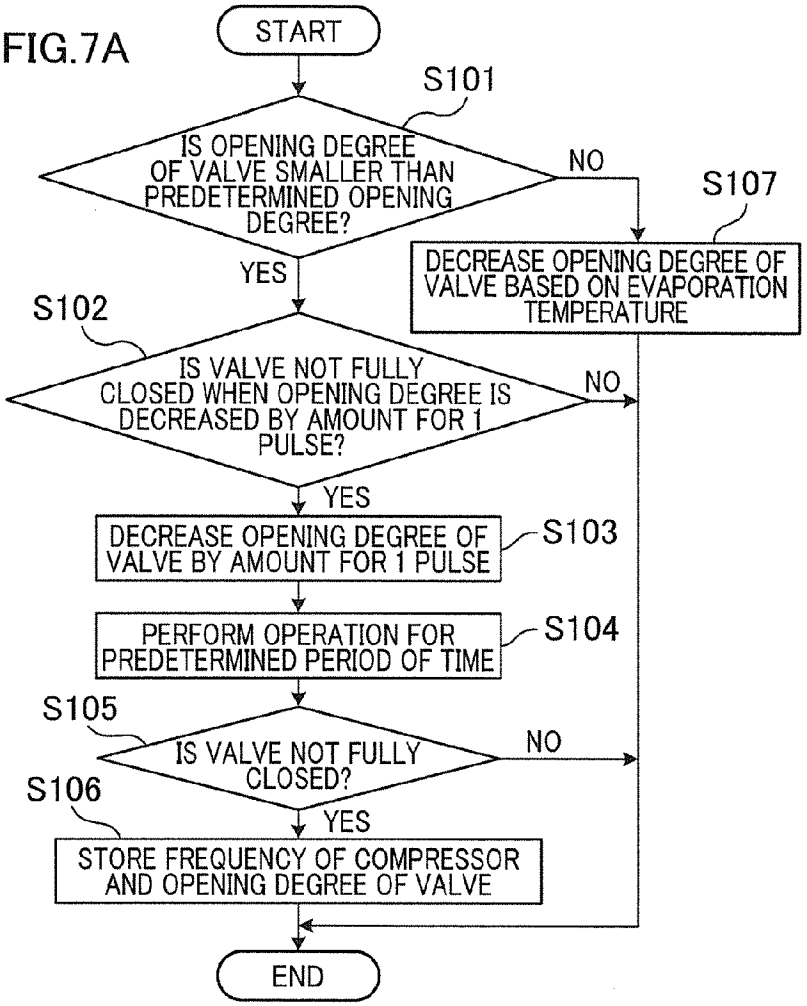

Now, description will be given for the control on the expansion valve 13 of the air conditioner 1, with reference to FIG. 7. As described above, the expansion valve 13 is controlled based on the evaporation temperature. Note that there is a difference in the way of control between the case where the opening degree is not larger than a predetermined opening degree ta close to the opening degree corresponding to the fully closed state and the case where the opening degree is larger than the predetermined opening degree ta. This is because the amount of change in the opening degree is reduced because the amount of change in flow rate to the amount of change in the opening degree is larger while the opening degree is close to the opening degree corresponding to the fully closed state. The predetermined opening degree ta is the opening degree t1 or an opening degree close to the opening degree t1.

In the control of the opening degree based on the evaporation temperature, first, it is determined whether the opening degree of the expansion valve is smaller than the predetermined opening degree ta when the opening degree needs to be changed so as to decrease (step S101). When it is determined that the opening degree of the valve is smaller than the predetermined opening degree ta (step S101: YES), it is determined whether the valve is not fully closed as a result of the decrease in the opening degree of the valve by an amount for one pulse (step S102). To be more specific, it is determined that the valve is not fully closed as a result of the decrease in the opening degree of the valve by the amount for one pulse when: the frequency of the compressor after the decrease is equal to or higher than a fully-closed-state compressor frequency (the frequency of the compressor assumed as corresponding to the fully closed state); and the opening degree of the valve is larger than a fully-closed-state opening degree (the opening degree of the valve assumed as corresponding to the fully closed state) by the amount for two pulses or more.

When it is determined that the valve is not fully closed as a result of the decrease in the opening degree of the valve by the amount for one pulse (step S102: YES), the opening degree of the valve is changed so as to decrease by the amount for one pulse (step S103), and operation is performed for a predetermined period of time (step S104). Then, it is determined whether the expansion valve is not fully closed (step S105). To be more specific, it is determined that the expansion valve is fully closed when the evaporation temperature decreases to be lower than that before the operation for the predetermined period of time by a predetermined temperature decrement (e.g., 5 degrees Celsius), or the evaporation temperature after the operation for the predetermined period of time is equal to or lower than a predetermined temperature (e.g., 5 degrees Celsius). Then, when it is determined that the valve is not fully closed (step S105: NO), the frequency of the compressor and the opening degree of the expansion valve at the time of determination are respectively stored as the fully-closed-state compressor frequency, and as the fully-closed-state opening degree (step S106).

When, in step S101, it is determined that the opening degree of the valve is equal to or larger than the predetermined opening degree to (step S101: NO), the opening degree of the valve is changed so as to decrease based on the evaporation temperature (step S107).

Further, when it is determined that the valve is fully closed as a result of the decrease in the opening degree of the valve by the amount for one pulse in step S102 (step S102: YES), and when it is determined that the expansion valve is fully closed in step S105 (step S105: NO), the opening degree is not changed.

Now, as described above, in the air conditioner 1, it is determined that the expansion valve is fully closed when the evaporation temperature decreases to be lower than that before the operation for the predetermined period of time by the predetermined temperature decrement, or when the evaporation temperature after the operation for the predetermined period of time is equal to or lower than the predetermined temperature. Accordingly, it may be more likely that it is determined that the valve is fully closed when the frequency of the compressor is high and the flow rate is large. Therefore, when the frequency of the compressor is low, there is a possibility that the opening degree can be decreased so as to be smaller than the opening degree stored as the fully-closed-state opening degree. Thus, in the air conditioner 1, it is determined whether it is possible to decrease the opening degree when the frequency of the compressor is lower than the stored fully-closed-state compressor frequency.

Meanwhile, when it is necessary to change the opening degree so as to increase under the control of the opening degree based on the evaporation temperature, it is determined whether the opening degree of the expansion valve is smaller than the predetermined opening degree ta (step S201). When it is determined that the opening degree of the valve is smaller than the predetermined opening degree ta (step S201: YES), the opening degree of the valve is changed so as to increase by the amount for one pulse (step S202).

When, in step S201, the opening degree of the valve is equal to or larger than the predetermined opening degree ta (step S201: NO), the opening degree of the valve is changed so as to increase based on the evaporation temperature (step S203).

<Characteristics of the Air Conditioner of this Embodiment>

In the air conditioner 1 of this embodiment, the evaporation temperature sensor 30 which detects the evaporation temperature is disposed downstream of the expansion valve 13 in the outdoor unit 3. This ensures detection of the reduction of the pressure (the reduction of the temperature) due to the blockage of the circuit at the time when the expansion valve 13 is fully closed. This further ensures that the flow rate is restricted just before the expansion valve 13 is fully closed even while the flow rate is very small, to decrease the evaporation temperature, for performing dehumidification.

Further, in the air conditioner 1 of this embodiment, the expansion valve 13 is configured so that its flow rate decreases with the decrease in its opening degree decreases while the expansion valve 13 is in the state close to the fully closed state. Therefore, the adjustment of the flow rate is possible even just before the full closure of the expansion valve 13, and the control on the evaporation temperature is possible even while the flow rate is very small.

Furthermore, in the air conditioner 1 of this embodiment, the expansion valve 13 is fully closable. Therefore, it is possible to sufficiently decrease the evaporating pressure with a minuscule opening degree just before the opening degree corresponding to the fully closed state.

Moreover, in the air conditioner 1 of this embodiment, when the opening degree of the expansion valve 13 is decreased toward the opening degree corresponding to the fully closed state, a decrement of the flow rate to the amount of change in the opening degree increases after the opening degree of the expansion valve 13 is decreased to the predetermined opening degree t1 close to the opening degree corresponding to the fully closed state. The amount of change in the flow rate to the amount of change in the opening degree is thus increased just before the valve is fully closed, and this increases the difference between the evaporation temperature in the fully closed state and that just before the fully closed state, to make it easier to recognize that the valve is about to be closed, thereby facilitating avoidance of the blockage of the circuit due to the full closure of the valve.

While the embodiment of the present invention has been described based on the figures, the scope of the invention is not limited to the above-described embodiment. The scope of the present invention is defined by the appended claims rather than the foregoing description of the embodiment, and various changes and modifications can be made herein without departing from the scope of the invention.

In the above-described embodiment, the auxiliary heat exchanger and the main heat exchanger may be formed into a single unit. In this case, the indoor heat exchanger is formed as a single unit, and a first portion corresponding to the auxiliary heat exchanger is provided on the most windward side of the indoor heat exchanger, and a second portion corresponding to the main heat exchanger is provided leeward from the first portion.

Further, the above-described embodiment deals with the air conditioner configured to operate in the cooling operation mode, in the predetermined dehumidification operation mode, and in the heating operation mode. However, the present invention may be applied to an air conditioner configured to conduct a dehumidification operation in a dehumidification operation mode other than the predetermined dehumidification operation mode, in addition to the dehumidification operation in the predetermined dehumidification operation mode.

INDUSTRIAL APPLICABILITY

The present invention ensures detection of the reduction of the pressure (the reduction of the temperature) due to the blockage of the circuit at the time when the expansion valve is fully closed.

REFERENCE SIGNS LIST

1 air conditioner
2 indoor unit
3 outdoor unit
10 compressor
12 outdoor heat exchanger

13 expansion valve
14 indoor heat exchanger
16 indoor fan
20 auxiliary heat exchanger
21 main heat exchanger

The invention claimed is:

1. An air conditioner comprising a refrigerant circuit in which a compressor, an outdoor heat exchanger, an expansion valve, and an indoor heat exchanger are connected to one another, the air conditioner configured to perform a cooling operation in which the entirety of the indoor heat exchanger functions as an evaporation region and a dehumidification operation in which a part of the indoor heat exchanger functions as the evaporation region, wherein:

the indoor heat exchanger includes a first part that functions as an auxiliary heat exchanger and a second part that functions as a main heat exchanger, the auxiliary heat exchanger being windward of the main heat exchanger, in the dehumidification operation, the compressor and the expansion valve are controlled so that a part of the auxiliary heat exchanger of the indoor heat exchanger that is in the vicinity of a liquid inlet functions as the evaporation region and a part of the auxiliary heat exchanger of the indoor heat exchanger that is downstream of the evaporation region and windward of the main heat exchanger functions as a superheat region, and so that an extent of the evaporation region varies depending on a load, the compressor, the outdoor heat exchanger, and the expansion valve are disposed in an outdoor unit;

the indoor heat exchanger is disposed in an indoor unit;

the expansion valve is configured so that its flow rate decreases with a decrease in its opening degree while the expansion valve is in a state close to a fully closed state, and is configured to be fully closable;

an evaporation temperature detecting unit configured to detect an evaporation temperature is disposed in the outdoor unit downstream of the expansion valve; and the fully closed state of the expansion valve is detected based on the evaporation temperature detected by the evaporation temperature detecting unit.

2. The air conditioner according to claim 1, wherein when the opening degree of the expansion valve is decreased toward the opening degree corresponding to the fully closed state, a decrement of the flow rate to an amount of change in the opening degree increases after the opening degree of the expansion valve is decreased to a predetermined opening degree close to the opening degree corresponding to the fully closed state.

3. The air conditioner according to claim 1, wherein a lower limit of the opening degree of the expansion valve is stored.

4. The air conditioner according to claim 2, wherein a lower limit of the opening degree of the expansion valve is stored.

* * * * *